US010280382B2

(12) United States Patent
Hirooka et al.

(10) Patent No.: US 10,280,382 B2
(45) Date of Patent: May 7, 2019

(54) LUBRICATING OIL FOR FLUID DYNAMIC BEARING AND SPINDLE MOTOR EQUIPPED WITH THE LUBRICATING OIL

(71) Applicants: KYODO YUSHI CO., LTD., Fujisawa-shi, Kanagawa (JP); NIDEC CORPORATION, Kyoto-shi, Kyoto (JP)

(72) Inventors: Iwaki Hirooka, Fujisawa (JP); Takayuki Oe, Kyoto (JP); Sayuri Tsubata, Kyoto (JP); Yuji Hagiwara, Kyoto (JP)

(73) Assignees: KYODO YUSHI CO., LTD., Fujisawa (JP); NIDEC CORPORATION, Kyoto (JP)

( * ) Notice: Subject to any disclaimer, the term of this patent is extended or adjusted under 35 U.S.C. 154(b) by 133 days.

(21) Appl. No.: 15/140,571

(22) Filed: Apr. 28, 2016

(65) Prior Publication Data

US 2016/0319215 A1 Nov. 3, 2016

(30) Foreign Application Priority Data

Apr. 30, 2015 (JP) ..... 2015-093250

(51) Int. Cl.
*C10N 30/10* (2006.01)
*C10N 40/02* (2006.01)
(Continued)

(52) U.S. Cl.
CPC ..... *C10M 169/04* (2013.01); *C10M 129/70* (2013.01); *C10M 2207/026* (2013.01);
(Continued)

(58) Field of Classification Search
CPC ..... C10M 169/04; C10M 129/70; C10M 2207/026; C10M 2207/2815;
(Continued)

(56) References Cited

U.S. PATENT DOCUMENTS 6,008,167 A * 12/1999 Appelman ..... C10M 105/34 508/463
2005/0222000 A1 10/2005 Horaguchi et al.
(Continued)

FOREIGN PATENT DOCUMENTS

CN 1676588 10/2005
JP 2007-46009 2/2007
(Continued)

OTHER PUBLICATIONS

Isofol, C12-C32 Guerbet Alcohols, retrieved from the Internet at <http://www.sasoltechdata.com/tds/ISOFOL.pdf> on Feb. 14, 2018.*
(Continued)

*Primary Examiner* — James C Goloboy
(74) *Attorney, Agent, or Firm* — Nixon & Vanderhye P.C.

(57) ABSTRACT

The invention provides a lubricating oil for fluid dynamic bearing including as a base oil a monoester oil free of unsaturated bond, and having an absolute viscosity of 2.0 to 3.0 mPa·s at 100° C. a viscosity index of 130 or more and a pour point of −20° C. or less.

8 Claims, 1 Drawing Sheet

(51) Int. Cl.
*C10M 129/70* (2006.01)
*C10M 169/04* (2006.01)

(52) U.S. Cl.
CPC ..... *C10M 2207/2815* (2013.01); *C10M 2215/064* (2013.01); *C10M 2215/066* (2013.01); *C10N 2030/10* (2013.01); *C10N 2040/02* (2013.01); *C10N 2230/02* (2013.01); *C10N 2230/10* (2013.01); *C10N 2230/60* (2013.01); *C10N 2230/74* (2013.01); *C10N 2240/02* (2013.01); *C10N 2240/204* (2013.01)

(58) Field of Classification Search
CPC ..... C10M 2215/064; C10M 2215/066; C10N 2230/02; C10N 2230/60; C10N 2230/74; C10N 2240/02; C10N 2240/204
See application file for complete search history.

(56) References Cited

U.S. PATENT DOCUMENTS

2007/0037715 A1 2/2007 Okada
2010/0035773 A1* 2/2010 Hirata ..... C10M 135/10 508/100
2010/0261628 A1* 10/2010 Scherer ..... C10M 105/34 508/496
2013/0096042 A1 4/2013 Oda
2013/0165356 A1 6/2013 Jung et al.
2014/0110143 A1* 4/2014 Han ..... C10M 169/04 174/30

FOREIGN PATENT DOCUMENTS

JP 4160772 10/2008
JP 2009-203275 A † 9/2009
JP 2009203275 A * 9/2009
JP 2013-82900 5/2013
JP 2013-133470 7/2013
JP 2014-139306 7/2014

OTHER PUBLICATIONS

Chinese Office Action issued in Appln. No. 201610279995.9 dated Apr. 20, 2018 (w/ partial translation).

* cited by examiner
† cited by third party

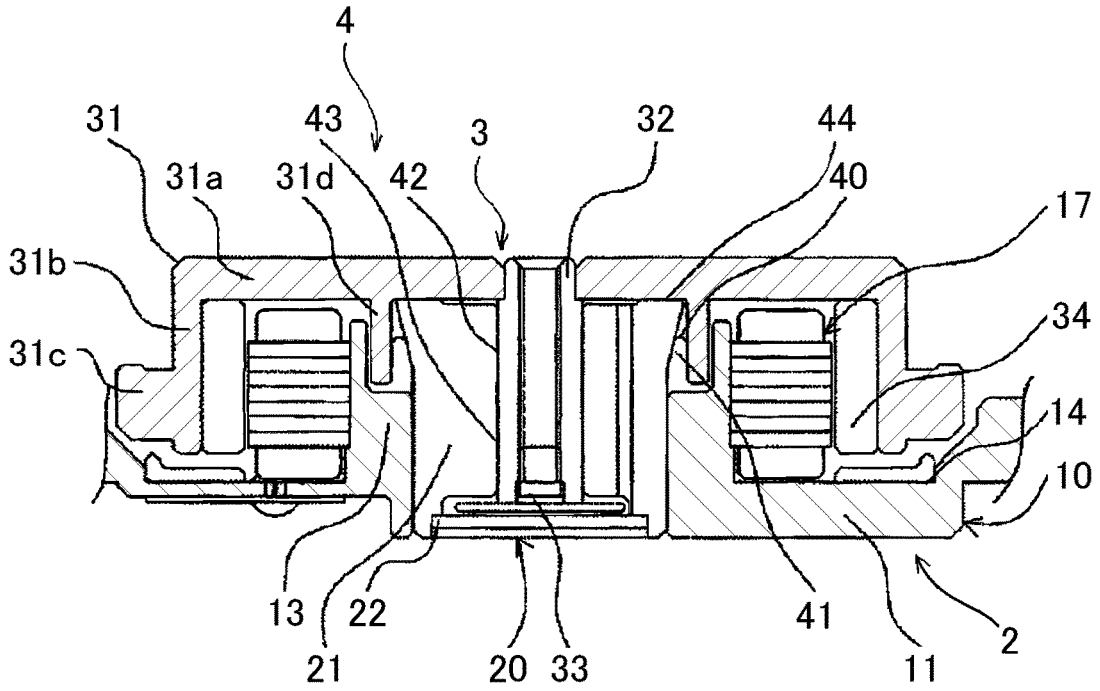
4
31
43
3
32
44
31a
31d
42
40
17
31b
34
31c
14
10
13
22
41
2
21
20
33
11

LUBRICATING OIL FOR FLUID DYNAMIC BEARING AND SPINDLE MOTOR EQUIPPED WITH THE LUBRICATING OIL

This application and claims priority to JP Patent Application No. 2015-093250, filed 30 Apr. 2015, the entire content of which is hereby incorporated by reference.

TECHNICAL FIELD

The present invention relates to a synthetic lubricating base oil, in particular a lubricating base oil for fluid dynamic bearings; a lubricating oil for fluid dynamic bearings comprising the above-mentioned base oil; and a spindle motor equipped with the above-mentioned lubricating oil.

BACKGROUND ART

The rotational bearings used in the motor for driving the hard disc, compact disc (CD) and digital video disc (DVD) are ball bearings and fluid dynamic bearings.

The ball bearings have the shortcoming that the load to the bearing becomes greater when used for a long time, which may readily cause vibration and noise. In the fluid dynamic bearings, on the other hand, rotation of the shaft makes the flow of lubricating oil, which generates a pressure to support the rotation of the shaft. Therefore, the shaft and the bearing portion do not come in direct contact with each other, so that the frictional resistance can be reduced and the vibration and the noise are favorably low. Owing to those advantages, the fluid dynamic bearings have been frequently used in recent years.

Recently, the fluid dynamic bearings have been required to be smaller in size, have higher precision, and rotate at higher speeds. This necessarily requires the lubricating oil for the fluid dynamic bearings to have low viscosity, excellent heat resistance, sufficient stability against oxidation, low evaporation properties.

When the lubricating oil for fluid dynamic bearings is heated to high temperatures, for example by continuous rotation of the motor, the lubricating oil thermally expands to reduce the viscosity thereof. In this case, the bearing stiffness may unfavorably tend to deteriorate, which may cause the problem that the bearing becomes too unstable to support the load of the rotator. In consideration of this, the viscosity of the lubricating oil used in the fluid dynamic bearings is required to exceed a certain level within the high temperature region.

When the lubricating oil stands in a low temperature region, for example at the initiation of the motor, the viscosity resistance tends to increase during the rotation if the viscosity of the lubricating oil is high. This will disadvantageously result in the increase of electric power loss in the motor. In consideration of this, it is required to minimize the increase of viscosity of the lubricating oil even when the lubricating oil is left at low temperatures. Namely, the viscosity of the lubricating oil used in the fluid dynamic bearing is required to be less changed when the temperature varies.

In addition, the rotating device generates static electricity, which is accumulated on the side facing to the device. To prevent the charged surface from discharging (overcurrent), the lubricating oil is also required to have antistatic properties.

JP 4160772 discloses di-n-octylate of 2,4-diethyl-1,5-pentanediol as the lubricating oil for the fluid dynamic bearing. This ester is reported to show more satisfactory results in terms of the viscosity index, low-temperature fluidity, thermal stability and low evaporation properties in a wider temperature range, which last a longer period of time when compared with poly α-olefins obtainable from polymers of 1-decene through hydrogenation, 2-ethylhexyl esters of adipic acid and sebacic acid, neopentyl glycol, pentaerythritol and the like. However, di-n-octylate of 2,4-diethyl-1,5-pentanediol is still insufficient in the thermal stability and the low evaporation properties at high temperatures.

SUMMARY OF INVENTION

Technical Problem

The problems to be solved by the invention are to satisfy the viscosity of the lubricating oil for the fluid dynamic bearing within an appropriate range at high temperatures so that the fluid dynamic bearing can securely support the load of the rotator, and at the same time, to prevent the viscosity of the lubricating oil for the fluid dynamic bearing from increasing at low temperatures. In addition, the invention also aims to reduce and stabilize the evaporation loss of the lubricating oil for the fluid dynamic bearing at high temperatures.

Accordingly, an object of the invention is to provide a lubricating oil for fluid dynamic bearing, the viscosity of which can stay within a range satisfactory for securely supporting the load of the rotator at high temperatures, and the viscosity of which can be prevented from increasing at low temperatures, and in addition, the evaporation loss of which can be reduced and stabilized at high temperatures.

Solution to Problem

The inventors of the present invention found that the above-mentioned problems can be improved by using a lubricating oil for fluid dynamic bearings which comprises as a base oil a monoester oil free of unsaturated hydrocarbon, and having an absolute viscosity of 2.0 to 3.0 mPa·s at 100° C., a viscosity index of 130 or more and a pour point of −20° C. or less. Namely, the invention provides the following grease composition:

1. A lubricating oil for fluid dynamic bearing comprising as a base oil a monoester oil free of unsaturated bond, and having an absolute viscosity of 2.0 to 3.0 mPa·s at 100° C., a viscosity index of 130 or more and a pour point of −20° C. or less.

2. The lubricating oil for fluid dynamic bearing of item 1 above, wherein the monoester oil, which is comprised of a β-alkyl branched saturated aliphatic alcohol and a saturated aliphatic carboxylic acid, is represented by formula (1):

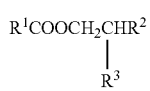

(1)

wherein $R^1$ is a straight-chain alkyl group having 7 to 11 carbon atoms; $R^2$ is a straight-chain alkyl group having 8 to 10 carbon atoms; and $R^1$ is a straight-chain alkyl group having 6 to 8 carbon atoms.

3. The lubricating oil for fluid dynamic bearing of item 2 above, wherein the β-alkyl branched aliphatic alcohol is at least one member selected from the group consisting of 2-pentyl nonanol, 2-pentyl decanol, 2-pentyl undecanol, 2-pentyl dodecanol, 2-pentyl tridecanol, 2-pentyl tetradecanol, 2-hexyl nonanol, 2-hexyl decanol, 2-hexyl undecanol, 2-hexyl dodecanol, 2-hexyl tridecanol, 2-hexyl tetradecanol, 2-heptyl nonanol, 2-heptyl decanol, 2-heptyl undecanol, 2-heptyl dodecanol, 2-heptyl tridecanol, 2-heptyl tetradecanol, 2-octyl nonanol, 2-octyl decanol, 2-octyl undecanol, 2-octyl dodecanol, 2-octyl tridecanol, 2-octl tetradecanol, 2-nonyl nonanol, 2-nonyl decanol, 2-nonyl undecanol, 2-nonyl dodecanol, 2-nonyl tridecanol, and 2-nonyl tetradecanol.

4. The lubricating oil for fluid dynamic bearing of item 2 above, wherein the aliphatic carboxylic acid is at least one member selected from the group consisting of butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, and octadecanoic acid.

5. The lubricating oil for fluid dynamic bearing of any one of items 1 to 4 above, wherein the monoester oil is a mixture of monoester compounds comprised of a mixture of 2-hexyl decanol, 2-octyl decanol, 2-hexyl dodecanol and 2-octyl dodecanol as the saturated aliphatic alcohols, and octanoic acid as the saturated aliphatic carboxylic acid.

6. The lubricating oil for fluid dynamic bearing of item 5 above, wherein the mixture of the saturated aliphatic alcohols comprises 5 to 7 parts by mass of 2-octyl decanol, 5 to 7 parts by mass of 2-hexyl dodecanol, and 0.5 to 1 part by mass of 2-octyl dodecanol with respect to one part by mass of 2-hexyl decanol.

7. The lubricating oil for fluid dynamic bearing of any one of items 1 to 4 above, wherein the monoester oil is a mixture of monoester compounds comprised of a mixture of 2-hexyl decanol, 2-octyl decanol, 2-hexyl dodecanol and 2-octyl dodecanol as the saturated aliphatic alcohols, and nonanoic acid as the saturated aliphatic carboxylic acid.

8. The lubricating oil for fluid dynamic bearing of item 7 above, wherein the mixture of the saturated aliphatic alcohols comprises a mixture of 5 to 7 parts by mass of 2-octyl decanol, 5 to 7 parts by mass of 2-hexyl dodecanol, and 0.5 to 1 part by mass of 2-octyl dodecanol with respect to one part by mass of 2-hexyl decanol.

9. The lubricating oil for fluid dynamic bearing of any one of items 1 to 4 above, wherein the monoester oil is a mixture of monoester compounds comprised of 2-hexyl decanol, 2-octyl decanol, 2-hexyl dodecanol and 2-octyl dodecanol as the saturated aliphatic alcohols, and decanoic acid as the saturated aliphatic carboxylic acid.

10. The lubricating oil for fluid dynamic bearing of item 9 above, wherein the mixture of the saturated aliphatic alcohols comprises a mixture of 5 to 7 parts by mass of 2-octyl decanol, 5 to 7 parts by mass of 2-hexyl dodecanol, and 0.5 to 1 part by mass of 2-octyl dodecanol with respect to one part by mass of 2-hexyl decanol.

11. The lubricating oil for fluid dynamic bearing of any one of items 1 to 4 above, wherein the monoester oil is a mixture of monoester compounds comprised of 2-hexyl decanol, 2-octyl decanol, 2-hexyl dodecanol and 2-octyl dodecanol as the saturated aliphatic alcohols, and dodecanoic acid as the saturated aliphatic carboxylic acid.

12. The lubricating oil for fluid dynamic bearing of item 11 above, wherein the mixture of the saturated aliphatic alcohols comprises a mixture of 5 to 7 parts by mass of 2-octyl decanol, 5 to 7 parts by mass of 2-hexyl dodecanol, and 0.5 to 1 part by mass of 2-octyl dodecanol with respect to one part by mass of 2-hexyl decanol.

13. The lubricating oil for fluid dynamic bearing of any one of items 1 to 12 above, wherein the base oil does not comprise any other lubricating base oil than the monoester oil.

14. The lubricating oil for fluid dynamic bearing of any one of items 1 to 13 above, further comprising two or more diphenylamine compounds as antioxidants.

15. The lubricating oil for fluid dynamic bearing of item 14 above, wherein the diphenylamine compounds are represented by formula (2) or (3):

(2)

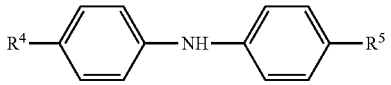

wherein $R^4$ and $R^5$ are both tert-octyl groups, (3)

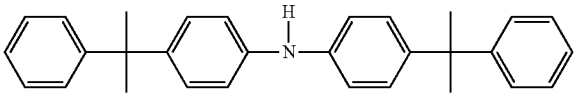

16. The lubricating oil for fluid dynamic bearing of item 14 or 15 above, wherein the content of the diphenylamine compounds is in the range of 0.01 to 5 mass % with respect to the lubricating oil for fluid dynamic bearing.

17. The lubricating oil for fluid dynamic bearing of any one of items 1 to 16 above, further comprising an antistatic agent.

18. The lubricating oil for fluid dynamic bearing of item 17 above, having a specific volume resistivity of $1.0\times10^{11}$ Ω·cm or less.

19. The lubricating oil for fluid dynamic bearing of item 17 or 18 above, wherein the content of the antistatic agent is in the range of 0.005 to 1.0 mass % with respect to the lubricating oil for fluid dynamic bearing.

20. A spindle motor comprising a stationary part having a stator, a rotary part having a rotor magnet, a fluid dynamic bearing which supports the rotary part rotatably with respect to the stationary part, and the lubricating oil for fluid dynamic bearing of any one of items 1 to 19 above.

Effects of Invention

The invention can provide a lubricating oil for fluid dynamic bearing where the viscosity can stay within a satisfactory range so as to securely support the load of the rotator at high temperatures, and at the same time, the viscosity can be prevented from increasing at low temperatures. In addition, the lubricating oil for fluid dynamic bearing according to the invention can exhibit less evaporation loss, which makes it possible to use the fluid dynamic bearing in a stable condition.

The lubricating oil of the invention shows a low viscosity, and at the same time, excellent lubricating properties over an extended period of time even if used under severely temperature-changing conditions.

BRIEF DESCRIPTION OF THE DRAWING

FIG. 1 is a schematic longitudinal section showing the structure of a spindle motor.

DESCRIPTION OF EMBODIMENTS

<Base Oil>

The base oil used in the invention comprises a monoester oil free of unsaturated bond. The monoester oil free of unsaturated bond is not particularly limited, but may preferably comprise a monoester formed from a R-alkyl branched saturated aliphatic alcohol and a saturated aliphatic carboxylic acid.

The total number of carbon atoms in the above-mentioned saturated aliphatic alcohol is 8 to 28, preferably 14 to 26, more preferably 16 to 22, and most preferably 16 to 20. Specific examples of the β-alkyl branched aliphatic alcohol include 2-pentyl nonanol, 2-pentyl decanol, 2-pentyl undecanol, 2-pentyl dodecanol, 2-pentyl tridecanol, 2-pentyl tetradecanol, 2-hexyl nonanol, 2-hexyl decanol, 2-hexyl undecanol, 2-hexyl dodecanol, 2-hexyl tridecanol, 2-hexyl tetradecanol, 2-heptyl nonanol, 2-heptyl decanol, 2-heptyl undecanol, 2-heptyl dodecanol, 2-heptyl tridecanol, 2-heptyl tetradecanol, 2-octyl nonanol, 2-octyl decanol, 2-octyl undecanol, 2-octyl dodecanol, 2-octyl tridecanol, 2-octyl tetradecanol, 2-nonyl nonanol, 2-nonyl decanol, 2-nonyl undecanol, 2-nonyl dodecanol, 2-nonyl tridecanol, 2-nonyl tetradecanol, and the like. The β-alkyl branched aliphatic alcohol may be used alone or two or more β-alkyl branched aliphatic alcohols may be used in combination. It is most preferable to use a mixture of 2-hexyl decanol, 2-octyl decanol, 2-hexyl dodecanol, and 2-octyl dodecanol. In this case, 5 to 7 parts by mass of 2-octyl decanol, 5 to 7 parts by mass of 2-hexyl dodecanol, and 0.5 to 1 part by mass of 2-octyl dodecanol may preferably be used with respect to one part by mass of 2-hexyl decanol.

The above-mentioned saturated aliphatic carboxylic acid may include straight-chain or branched saturated aliphatic carboxylic acids. The number of carbon atoms in the saturated aliphatic carboxylic acid is 4 to 18, preferably 6 to 14, and most preferably 8 to 12. Specific examples of the aliphatic carboxylic acid include butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid and the like. In particular, hexanoic acid, heptanoic acid, octanoic acid, nonanoic acid, decanoic acid, undecanoic acid, dodecanoic acid, tridecanoic acid, and tetradecanoic acid are preferred. Further, octanoic acid, nonanoic acid, decanoic acid, undecanoic acid and dodecanoic acid are more preferably used. The saturated aliphatic carboxylic acid may be used alone or two or more saturated aliphatic carboxylic acids may be used in combination.

In particular, it is preferable to use a mixture of monoester compounds comprised of a mixture of 2-hexyl decanol, 2-octyl decanol, 2-hexyl dodecanol and 2-octyl dodecanol as the saturated aliphatic alcohols, and octanoic acid as the saturated aliphatic carboxylic acid. A mixture of monoester compounds comprised of a mixture of 2-hexyl decanol, 2-octyl decanol, 2-hexyl dodecanol and 2-octyl dodecanol as the saturated aliphatic alcohols, and nonanoic acid as the saturated aliphatic carboxylic acid is also preferable. In addition, a mixture of monoester compounds comprised of 2-hexyl decanol, 2-octyl decanol, 2-hexyl dodecanol and 2-octyl dodecanol as the saturated aliphatic alcohols, and decanoic acid as the saturated aliphatic carboxylic acid is also preferable. Also, a mixture of monoester compounds comprised of 2-hexyl decanol, 2-octyl decanol, 2-hexyl dodecanol and 2-octyl dodecanol as the saturated aliphatic alcohols, and dodecanoic acid as the saturated aliphatic carboxylic acid is preferable. In such cases, 2-hexyl decanol, 2-octyl decanol, 2-hexyl dodecanol and 2-octyl dodecanol may preferably be used as a mixture at the above-mentioned ratios.

As far as the performance does not lower, the base oil used in the invention may appropriately further comprise at least one kind of other lubricating base oil selected from the group consisting of mineral oils, poly α-olefins, polybutenes, alkylbenzenes, animal and vegetable oils, organic acid esters, polyalkylene glycols, polyvinyl ethers, polyphenyl ethers, alkylphenyl ethers, silicone compounds. The amount of the additional base oil used in combination with the above-mentioned monoester oil may preferably be 0 to 50 mass % with respect to the amount of the monoester oil; more preferably 0 to 20 mass % in order not to impair the low-temperature characteristics; and most preferably 0 to 10 mass % in order to prevent the low-temperature characteristics and the evaporation loss from deteriorating. Most advantageously, the base oil of the invention may not comprise any other additional lubricating base oils than the monoester oil.

The content of the base oil may preferably be 80 to 100 mass %, more preferably 90 to 100 mass %, and most preferably 95 to 100 mass %, with respect to the total mass of the lubricating oil for fluid dynamic bearing according to the invention.

The lubricating oil for fluid dynamic bearing according to the invention has an absolute viscosity of 2.0 to 3.0 mPa·s at 100° C. When the lubricating oil thermally expands to show an absolute viscosity of less than 2.0 mPa·s, the bearing stiffness may be so lowered that the load of the rotator cannot be supported. When the absolute viscosity exceeds 3.0 mPa·s, the viscosity resistance of the lubricating oil may increase and this may disadvantageously result in the increase of electric power loss in the motor.

The viscosity index of the lubricating oil for fluid dynamic bearing according to the invention is 130 or more, preferably 140 or more, when consideration is given to control of the viscosity at low temperatures. The viscosity index herein used is the index which represents the change in viscosity consequent to the change of temperature and can be determined experimentally. In general, a lubricating oil having a greater viscosity index shows a smaller change in viscosity when the temperature changes; and a lubricating oil having a smaller viscosity index shows a greater change in viscosity when the temperature changes.

The pour point of the lubricating oil for fluid dynamic bearing according to the invention is −20° C. or less, preferably −25° C. or less, and more preferably −30° C. or less, to ensure the fluidity at low temperatures.

<Additives>

The lubricating oil for fluid dynamic bearing according to the invention comprises the above-mentioned base oil, and may further comprise additives such as an antioxidant, a hydrolysis preventing agent, an antistatic agent and the like to improve the performance when necessary.

When the antioxidant is added, an amine-based antioxidant and/or a phenol-based antioxidant may be used in combination. More preferably, two or more kinds of amine-based antioxidants may be used in combination, and more preferably two or more kinds of diphenylamine compounds may be added in combination. The diphenylamine compounds represented by the following formula (2) or (3) are most preferable.

(2)

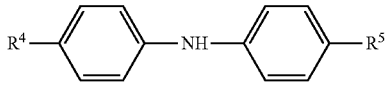

wherein $R^4$ and $R^5$ are both tert-octyl groups, (3)

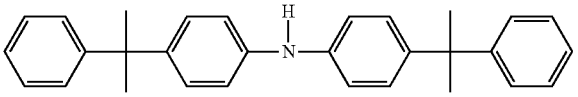

The content of the antioxidant may preferably be in the range of 0.01 to 5 mass % with respect to the lubricating oil for fluid dynamic bearing.

As the hydrolysis preventing agent, carbodiimide compounds are preferable. The content of the hydrolysis preventing agent may preferably be in the range of 0.01 to 5 mass % with respect to the lubricating oil for fluid dynamic bearing.

Preferable examples of the antistatic agent include anionic antistatic agents such as alkylbenzene sulfonic acids, alkylnaphthalene sulfonic acids, sulfonates, salicylates, phenates and the like; cationic antistatic agents such as alkylamine salts, quatemary ammonium salts and the like; amphoteric antistatic agents such as alkylbetaines, amine oxides and the like; and nonionic antistatic agents such as polyoxyethylene alkyl ethers, sorbitan fatty acid esters and the like. In particular, anionic antistatic agents are preferable, and alkylbenzenesulfonic acids, alkylnaphthalene sulfonic acids, sulfonates, salicylates and phenates are more preferable. In the sulfonates, salicylates and phenates, metallic salts with calcium (Ca) or zinc (Zn) are particularly preferred. Dinonylnaphthalene sulfonic acid is most preferable.

The content of the antistatic agent may preferably be in the range of 0.005 to 1.0 mass %, more preferably 0.005 to 0.5 mass %, and most preferably 0.01 to 0.2 mass %, with respect to the lubricating oil for fluid dynamic bearing.

The lubricating oil for fluid dynamic bearing according to the invention may have a specific volume resistivity of $1.0\times10^{11}$ Ω·cm or less, and more preferably $5.0\times10^{10}$ Ω·cm or less, from the viewpoint of prevention of discharging.

One preferable embodiment of the invention will now be explained by referring to the drawing.

FIG. 1 is a schematic longitudinal section showing the structure of a spindle motor. The spindle motor has a stationary part 2 and a rotary part 4. The rotary part 4 is rotatably supported by a fluid dynamic bearing 3 according to the embodiment with respect to the stationary part 2. When explaining the position and the direction of the constituent members in this embodiment, the terms of top and bottom and left and right are used based on the position and the direction on the drawing, not indicating the position and the direction of the members which are practically incorporated into an equipment.

A base plate 10 has a flat portion 11 provided in the center of the base plate 10 and a boss portion 13 provided in the center of the flat portion 11. An annular hollow space is formed between the boss portion 13 and a ring-shaped step portion 14 provided on the periphery of the flat portion 11. A stator 17 fixed onto the flat portion 11 and a rotor magnet 34 fixed by a hub 31 (to be explained later) are placed in the annular hollow space. The stator 17 is disposed outward with respect to the boss portion 13 in a direction of the diameter.

A bearing stationary part 20 constituting a part of the fluid dynamic bearing 3 is disposed inward with respect to the boss portion 13 in a direction of the diameter. The bearing stationary part 20 has a sleeve 21 in a generally cylindrical form and a counter plate 22 which seals the opening at the bottom end of the sleeve 21.

The rotary part 4 has the hub 31 in the form of a cup and a shaft 32 positioned at the center of rotation of the hub 31.

In the hub 31, a cylindrical portion 31*b* is disposed at the outer end of a disc portion 31*a*. At the bottom end of the cylindrical portion 31*b*, there is disposed a flange portion 31*c* which extends outward in the diameter direction. A ring-shaped wall 31*d* is disposed inward with respect to the cylindrical portion 31*b*.

The outer surface of the shaft 32 and the inner surface of the sleeve 21 face to each other in the diameter direction via a small gap. To the bottom end of the shaft 32 a ring-shaped member 33 is fixed. The outer diameter of the ring-shaped member 33 is greater than that of the shaft 32.

In the cylindrical portion 31*b* of the hub 31, the ring-shaped rotor magnet 34 is disposed, which has a plurality of magnetic poles circumferentially arranged. The rotor magnet 34 is disposed in such a configuration that the perimeter of the stator 17 is enclosed by the rotor magnet 34.

On the flange portion 31*c* of the hub 31, one or a plurality of recording discs are placed. In this embodiment, a hard disc is used as the recording disc.

A small gap is formed between the sleeve 21 and the counter plate 22, between the shaft 32 and the ring-shaped member 33, and between the bottom of the disc portion 31*a* of the hub 31 and the top of the sleeve 21. Those small gaps are filled with a lubricating oil 40.

The lubricating oil 41 comes in contact with the outside air at a capillary sealing portion 41 which is formed by the inner surface of the ring-shaped wall 31*d* and the outer surface of the sleeve 21 facing to the above-mentioned inner surface of the ring-shaped wall 31*d* in the diameter direction. The meniscus (the vapor-liquid interface) formed by the lubricating oil 40 is found in the capillary sealing portion 41. The capillary sealing portion 41 is tapered so that the gap becomes smaller toward the top.

A pair of radial pressure bearing portions 42 and 43 having a series of herringbone-shaped grooves for generating dynamic pressure are formed between the inner surface of the sleeve 21 and the outer surface of the shaft 32. The series of the grooves for generating radial dynamic pressure can generate a force to support the shaft 32 in the diameter direction when the spindle motor is rotated in a predetermined direction. Between the top of the sleeve 21 and the bottom of the disc portion 31*a*, a thrust pressure bearing portion 44 is formed where a series of the grooves for generating thrust dynamic pressure are spirally provided. The series of grooves for generating thrust dynamic pressure can increase the pressure of lubricating oil within the region where the series of grooves for generating thrust dynamic pressure are arranged in the diameter direction when the spindle motor is rotated in a predetermined direction, and in addition generate a force to float the hub 31 upward in the axial direction.

As mentioned above, this embodiment indicates a spindle motor of a rotational shaft type, equipped with the rotatable shaft 32. However, the invention is not limited to the above-mentioned embodiment. For example, the invention can favorably apply to a spindle motor of a fixed shaft type, equipped with a shaft not rotated.

The invention can advantageously apply to a variety of industrial motors using the fluid dynamic bearing.

The invention will now be explained more specifically by referring to the following examples.

EXAMPLES

<Preparation of Monoester Oils>

A one-liter four-necked flask fitted with a stirrer, a thermometer, a nitrogen inlet and a distilling receiver (with a condenser) was loaded with a mixture (1238 g) of 2-hexyl decanol, 2-octyl decanol, 2-hexyl dodecanol and 2-octyl dodecanol, and n-octanoic acid (792 g) to cause a reaction at 200° C. and the atmospheric pressure for eight hours. Under reduced pressure (0.4 kPa), an excess of the fatty acids was distilled away. After the reaction mixture was washed with a 20% aqueous solution of sodium hydroxide (200 g) at 80° C., and subsequently washed with one-liter of water four times. Water was removed at 210° C. or less under reduced pressure (0.4 kPa or less) for two hours, thereby obtaining a desired ester compound. The monoester oil thus obtained was used as a base oil in Example 1.

The monoester oils or diester oils used in other Examples and Comparative Examples were also prepared in the same manner as mentioned above except that alcohols and carboxylic acids shown in Table 1 were used. The alcohols are represented by the following abbreviations in Table 1:

2-HXDOH: 2-hexyl decanol

2-HXDDOH: 2-hexyl dodecanol

2-OCDOH: 2-octyl decanol

2-OCDDOH: 2-octyl dodecanol

<Preparation of Lubricating Oils for Fluid Dynamic Bearing>

By adding the additives described in Table 1 to the monoester oil or diester oil obtained above, lubricating oils for fluid dynamic bearing were prepared in Examples and Comparative Examples. The additives are represented by the following abbreviations in Table 1:

Phenol based antioxidant A: pentaerythritol tetrakis-[3-(3,5-di-tert-butyl-4-hydroxy phenyl)propionate]

Amine based antioxidant A: octylated diphenylamine

Amine based antioxidant B: dicumyl diphenylamine

Amine based antioxidant C: N-phenyl-1-naphthylamine

Amine based antioxidant D: mixture of 2,2'-diethyl-4-nonyldiphenylamine and 2,2'-diethyl-4,4'-dinonyldiphenylamine Antistatic agent A: dinonylnaphthalene sulfonic acid <Test Methods>

1. Absolute Viscosity

Using a kinematic viscosity bath (Cat. No. 403DS, made by RIGO Co., Ltd.) and Ubbelohde type viscometers (viscometer numbers: 0B (100° C.), IA (40° C.)), the kinematic viscosity of each lubricating oil was determined in accordance with the JIS K 2283 3.:1983.

The densities at 5° C., 15° C. and 90° C. were determined using a density/specific gravity meter (DA-640, made by Kyoto Electronics Manufacturing Co., Ltd.), and the temperature—density linear approximation line derived from the measurement results was used to calculate the density at 100° C. The absolute viscosity was calculated from the kinematic viscosity and the density.

2. Viscosity Index

The kinematic viscosity values at 100° C. and 40° C. were used to calculate the viscosity index in accordance with the JIS K 2283 4.:1983.

3. Pour Point

The pour point was determined in accordance with the JIS K 2269:1987, using a pour tester (Cat. No. 520R-14L, made by RIGO Co., Ltd.)

4. Evaporation Loss

Five gram of each oil was precisely weighed and placed in a 20-ml sample bottle. Each oil was allowed to stand in a thermostat oven of 120° C. for 1,000 hours, and then the evaporation loss was determined.

5. Specific Volume Resistivity

The specific volume resistivity was determined in accordance with the JIS C 2101, using a super megohmmeter (SM-10E, made by Toa Denpa Kogyo).

<Evaluation Criteria>

The results of the above-mentioned test items 1 to 4 were evaluated on the basis of the following criteria. The results are shown in Table 1.

Overall Evaluation

All the test items 1 to 4 score "o" or "oo": o (acceptable)

Even one test item scores "x": x (unacceptable)

1. Absolute Viscosity 2.0 to 3.0 mPa·s: o

2. Viscosity Index 130 or more: o

Less than 130: x

3. Pour Point

−20° C. or less: o

More than −20° C.: x

4. Evaporation Loss

The evaluation loss (mass %) after each sample was allowed to stand at 120° C. for 1000 hours was expressed as the ratio to the evaporation loss obtained in Comparative Example 1.

Ratio of evaporation loss (%)=100×[evaporation loss (mass %) of a sample]/[evaporation loss (mass %) obtained in Comparative Example 1]

0.5 or less: oo

More than 0.5 and 0.8 or less: o

More than 0.8: x

5. Specific Volume Resistivity $1.0\times10^{11}$ Ω·cm or less: o

More than $1.0\times10^{11}$ Ω·cm: x

TABLE 1

| | | | Ex. 1 Monoester | Ex. 2 Monoester | Ex. 3 Monoester | Ex. 4 Monoester | Ex. 5 Monoester | Ex. 6 Monoester |
|---|---|---|---|---|---|---|---|---|
| Base oil | Alcohol(s) | 2-HXDOH | 8 | 7 | 7 | 7 | 7 | 7 |
| | (mass %*1) | 2-HXDDOH | 43 | 44 | 44 | 44 | 44 | 44 |
| | | 2-OCDOH | 43 | 44 | 44 | 44 | 44 | 44 |
| | | 2-OCDDOH | 6 | 5 | 5 | 5 | 5 | 5 |
| | Carboxylic acid | | n-octanoic acid | n-decanoic acid | n-dodecanoic acid | n-decanoic acid | n-decanoic acid | n-decanoic acid |

TABLE 1-continued

| | | | | | | | |
|---|---|---|---|---|---|---|---|
| Additives (mass %*2) | Phenol based antioxidant A | 1 | 1 | 1 | | | |
| | Amine based antioxidant A | 0.1 | 0.1 | 0.1 | 1 | | 1 |
| | Amine based antioxidant B | | | | 1 | | 1 |
| | Amine based antioxidant C | | | | | 1 | |
| | Amine based antioxidant D | | | | | 1 | |
| | Antistatic agent A | | | | | | 0.075 |
| Absolute viscosity at 100° C. (mPa · s) | | 2.26 | 2.38 | 2.91 | 2.41 | 2.40 | 2.41 |
| Viscosity index | | 149 | 151 | 176 | 150 | 151 | 150 |
| Pour point (° C.) | | −40 | −30 | −30 | −30 | −30 | −30 |
| Evaporation loss (%) | | 0.78 | 0.54 | 0.17 | 0.49 | 0.55 | 0.49 |
| Specific volume resistivity (Ω · cm) | | — | — | — | — | — | $2.4 \times 10^9$ |
| Overall evaluations | | ○ | ○ | ○ | ○ | ○ | ○ |

| | | Comp. Ex. 1 Diester | Comp. Ex. 2 Diester | Comp. Ex. 3 Monester | Comp. Ex. 4 Polyol ester | Comp. Ex. 5 Poly α-olefin |
|---|---|---|---|---|---|---|
| Base oil | Alcohol(s) (mass %*1) | 2,4-diethyl-1,5-pentanediol | 1,9-nonanediol 2-methyl-1,8-octanediol | 2-butyl octanol | Penta-erythritol | — |
| | Carboxylic acid | n-octanoic acid | Heptanoic acid | linoleic acid | Heptanoic acid Octanoic acid | — |
| Additives (mass %*2) | Phenol based antioxidant A | 1 | 1 | 1 | 1 | 1 |
| | Amine based antioxidant A | 0.1 | 0.1 | 0.1 | 0.1 | 0.1 |
| Absolute viscosity at 100° C. (mPa · s) | | 2.49 | 2.40 | 2.78 | 5.40 | 3.28 |
| Viscosity index | | 133 | 173 | 212 | 122 | 137 |
| Pour point (° C.) | | <−60 | −22.5 | −35 | −50 | <−60 |
| Evaporation loss (%) | | 1.00 | 2.26 | 6.57 | 0.78 | 0.86 |
| Overall evaluations | | x | x | x | x | x |

*1The numerals are individually expressed by mass % based on the total mass of four kinds of alcohols.
*2The numerals are individually expressed by mass % based on the total mass of each lubricating oil.

As can be seen from Table 1, the viscosities of the lubricating oils for fluid dynamic bearing according to the invention are within such a region that can securely support the load of the rotator at high temperatures, and the increase in viscosity can be minimized at low temperatures. Not only the viscosity characteristics are thus excellent, but also the results of the evaporation loss and the pour point are satisfactory. Consequently, the present invention is suitable as the lubricating oil for fluid dynamic bearing.

EXPLANATION OF NUMERALS

2 Stationary part
3 Fluid dynamic bearing
4 Rotary part
17 Stator
20 Bearing stationary part
21 Sleeve
22 Counter plate
31 Hub
31*a* Disc portion
31*d* Ring-shaped wall
32 Shaft
33 Ring-shaped member
34 Rotor magnet
40 Lubricating oil
41 Capillary sealing portion
42, 43 Radial pressure bearing portion
44 Thrust pressure bearing portion

What is claimed is:

1. A lubricating oil for fluid dynamic bearing comprising as a base oil a monoester oil free of unsaturated bond, and having an absolute viscosity of 2.0 to 3.0 mPa·s at 100° C., a viscosity index of 130 or more and a pour point of −20° C. or less, wherein the monoester oil is a mixture of monoester compounds, each of which is the reaction product of a mixture of 2-hexyl decanol, 2-octyl decanol, 2-hexyl dodecanol and 2-octyl dodecanol as the saturated aliphatic alcohols, and octanoic acid, nonanoic acid, decanoic acid or dodecanoic acid as the saturated aliphatic carboxylic acid, wherein the mixture of the saturated aliphatic alcohols comprises 5 to 7 parts by mass of 2-octyl decanol, 5 to 7 parts by mass of 2-hexyl dodecanol, and 0.5 to 1 part by mass of 2-octyl dodecanol with respect to one part by mass of 2-hexyl decanol, wherein the base oil is contained in an amount of 95 to 98.9 mass % with respect to the total mass of the lubricating oil, and wherein the base oil does not comprise any other lubricating base oil than the monoester oil.

2. The lubricating oil for fluid dynamic bearing of claim 1, further comprising two or more diphenylamine compounds as antioxidants.

3. The lubricating oil for fluid dynamic bearing of claim 2, wherein the diphenylamine compounds are represented by formula (2) or (3):

(2)

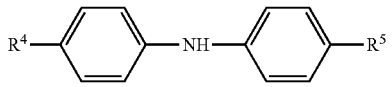

wherein $R^4$ and $R^5$ are both tert-octyl groups, (3)

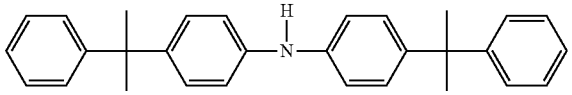

4. The lubricating oil for fluid dynamic bearing of claim 2, wherein the content of the diphenylamine compounds is in the range of 0.01 to 5 mass % with respect to the lubricating oil for fluid dynamic bearing.

5. The lubricating oil for fluid dynamic bearing of claim 1, further comprising an antistatic agent.

6. The lubricating oil for fluid dynamic bearing of claim 5, having a specific volume resistivity of $1.0\times10^{11}$ Ω·cm or less.

7. The lubricating oil for fluid dynamic bearing of claim 5, wherein the content of the antistatic agent is in the range of 0.005 to 1.0 mass % with respect to the lubricating oil for fluid dynamic bearing.

8. A spindle motor comprising a stationary part having a stator, a rotary part having a rotor magnet, a fluid dynamic bearing which supports the rotary part rotatably with respect to the stationary part, and the lubricating oil for fluid dynamic bearing of claim 1.

* * * * *